US009166303B2

(12) United States Patent
Khansa et al.

(10) Patent No.: US 9,166,303 B2
(45) Date of Patent: Oct. 20, 2015

(54) FULL TENSION SWAGED CONNECTOR FOR REINFORCED CABLE

(75) Inventors: Eyass Khansa, Long Beach, CA (US); Luis Sosa, Los Angeles, CA (US)

(73) Assignee: DMC Power, Inc., Carson, CA (US)

( * ) Notice: Subject to any disclaimer, the term of this patent is extended or adjusted under 35 U.S.C. 154(b) by 480 days.

(21) Appl. No.: 13/413,473

(22) Filed: Mar. 6, 2012

(65) Prior Publication Data

US 2013/0043073 A1 Feb. 21, 2013

Related U.S. Application Data

(63) Continuation-in-part of application No. 13/274,503, filed on Oct. 17, 2011, now abandoned.

(60) Provisional application No. 61/523,530, filed on Aug. 15, 2011.

(51) Int. Cl.

| | |
|---|---|
| ***H01R 4/18*** | (2006.01) |
| ***H01R 4/20*** | (2006.01) |
| ***H01R 4/62*** | (2006.01) |

(52) U.S. Cl.

CPC ..... *H01R 4/188* (2013.01); *H01R 4/203* (2013.01); *H01R 4/62* (2013.01); *Y10T 29/49181* (2015.01)

(58) Field of Classification Search

CPC ..... H02G 15/043; H01R 4/40; H01R 4/22
USPC ..... 174/74 R, 84 C, 88 R
See application file for complete search history.

(56) References Cited

U.S. PATENT DOCUMENTS

| | | | | |
|---|---|---|---|---|
| 1,886,086 | A * | 11/1932 | Damon | 403/185 |
| 1,909,344 | A | 5/1933 | Green et al. | |
| 2,188,178 | A | 1/1940 | Eby | |

(Continued)

FOREIGN PATENT DOCUMENTS

| | | |
|---|---|---|
| CN | 101641838 | 2/2010 |
| CN | 201741817 | 2/2011 |

(Continued)

OTHER PUBLICATIONS

Canadian Examination Report dated Sep. 12, 2013, Canadian Patent Appln. No. 2,778,681, 3 pages.

(Continued)

*Primary Examiner* — Chau N Nguyen
(74) *Attorney, Agent, or Firm* — Blakely Sokoloff Taylor & Zafman LLP

(57) ABSTRACT

An improved cable connector includes a connector insert having an axial bore dimensioned to receive the core of a reinforced cable. A connector body has a substantially cylindrical outer surface and a substantially cylindrical cavity. A distal portion of the cavity is dimensioned to receive the connector insert. A second portion of the cavity proximally displaced from the distal portion is dimensioned to receive the conductor strands of the cable. The connector body may be configured with one or more additional portions of the cavity having progressively increasing diameters, the number of such portions depending on the size of the cable. Alternatively, the inner surface of the cavity may have a slight taper. Using a single die, the connector body is compressed with a swaging tool at several axially spaced-apart locations to grip the conductor strands and also to grip the connector insert.

8 Claims, 3 Drawing Sheets

(56) References Cited

U.S. PATENT DOCUMENTS

| | | | | |
|---|---|---|---|---|
| 2,799,721 | A | 7/1957 | Floyd, Jr. | |
| 2,958,723 | A | 11/1960 | Logan et al. | |
| 3,033,600 | A | 5/1962 | Drysdale | |
| 3,052,750 | A | 9/1962 | Cobaugh | |
| 3,125,630 | A | 3/1964 | Wahl | |
| 3,184,535 | A | 5/1965 | Worthington | |
| 3,976,385 | A | 8/1976 | Klopfer | |
| 3,996,417 | A | 12/1976 | Annas | |
| 4,453,034 | A | 6/1984 | Annas et al. | |
| 4,511,280 | A | 4/1985 | Saint-Prix et al. | |
| 4,681,382 | A | 7/1987 | Lockard | |
| 4,817,682 | A | 4/1989 | Williams | |
| 4,829,146 | A | 5/1989 | Duve | |
| 5,069,058 | A | 12/1991 | Hyatt | |
| 5,516,158 | A | 5/1996 | Watts | |
| 5,600,096 | A | 2/1997 | Cherry et al. | |
| 5,654,527 | A | 8/1997 | Ciobanu et al. | |
| 5,821,463 | A | 10/1998 | Ngo | |
| 6,015,953 | A | 1/2000 | Tosaka et al. | |
| 6,165,004 | A | 12/2000 | Robinson | |
| 6,734,359 | B2 | 5/2004 | Hanazaki et al. | |
| 7,049,520 | B1 | 5/2006 | Tamm et al. | |
| 7,299,674 | B2 | 11/2007 | Palejwala et al. | |
| 7,311,553 | B2 | 12/2007 | Tamm | |
| 7,337,514 | B2 | 3/2008 | McKay | |
| 7,342,175 | B2 | 3/2008 | De France | |
| 7,531,747 | B2 | 5/2009 | Tamm et al. | |
| 7,874,881 | B1 | 1/2011 | Sosa et al. | |
| 2003/0155147 | A1* | 8/2003 | Robinson | 174/65 SS |
| 2006/0026824 | A1* | 2/2006 | Kramer | 29/751 |
| 2006/0105639 | A1 | 5/2006 | Tamm | |
| 2008/0023224 | A1 | 1/2008 | Gumley | |

FOREIGN PATENT DOCUMENTS

| | | |
|---|---|---|
| FR | 2285001 | 4/1976 |
| JP | 5155980 | 5/1976 |
| JP | 0584135 | 11/1993 |
| JP | 07250418 | 9/1995 |
| JP | 11187524 | 7/1999 |
| RU | 2372697 | 11/2009 |

OTHER PUBLICATIONS

Russian Official Action dated Oct. 10, 2013, Russian Patent Appln. No. 2012134837, 9 pages.
Japanese Official Action dated Jan. 6, 2014, Japanese Patent Appln. No. 2012-179864, 4 pages.
Office Action mailed Jan. 15, 2014, U.S. Appl. No. 13/274,503.
Tension Splicers, The Homac Companies, Brochure, 101-102.
Transmission Connectors, Hubbell Power Systems, Inc., Specifications, Section TC, (Nov. 2008), TC-4-TC-5.
Transmission Connectors, Hubbell Power Systems, Inc., Specifications, Section TA, (Apr. 2008), TA-13-TA-14.
AFL Telecommunications, ACA Conductor Accessories, Compression Joints—33000 Series for ACSR Conductors, (Sep. 18, 2009), 1 page.
AFL Telecommunications, ACA Conductor Accessories, Compression Dead Ends—33100 Series for ACSR Conductor Eye or Clevis Type, Single Tongue, (Sep. 18, 2009), 1 page.
Chinese Official Action dated Aug. 18, 2014, Chinese Patent Appln. No. 201210242377.9, with English-language translation, 24 pages.
Extended European Search Report dated Oct. 30, 2014, EP Appln. No. 12177292, 8 pages.
Rospatent Decision of Grant dated Jul. 11, 2014, Russian Patent Appln. No. 2012134837, with English-language translation, 12 pages.
Japanese Official Action dated Jul. 23, 2014, Japanese Patent Appln. No. 2012179864 with English-language translation, 3 pages.

* cited by examiner

FULL TENSION SWAGED CONNECTOR FOR REINFORCED CABLE

CROSS-REFERENCE TO RELATED APPLICATION

This application is a continuation-in-part of application Ser. No. 13/274,503 filed Oct. 17, 2011.

BACKGROUND OF THE INVENTION

1. Field of the Invention

This invention relates to the field of electrical power transmission and, more particularly, to full tension connectors for reinforced cables having a load-carrying core surrounded by conductor strands, which are used in electrical substations and high-tension power transmission lines.

2. Background

High-capacity, high-strength reinforced stranded cables are typically used in overhead power lines. An example of such a cable is Aluminum Conductor, Steel Reinforced (ACSR). In ACSR, the outer strands are aluminum, chosen for its excellent conductivity, low weight and low cost. The outer strands surround one or more center strands of steel, which provide the strength required to support the weight of the cable without stretching the ductile aluminum conductor strands. This gives the cable an overall higher tensile strength compared to a cable composed of only aluminum conductor strands. Other types of reinforced cable having a load-carrying core surrounded by conductor strands include, but are not limited to, Aluminum Conductor, Steel Supported (ACSS), Aluminum-Clad Steel Supported (ACSS/AW), Aluminum Conductor, Steel Supported (Trapezoidal Shaped Aluminum Strands) (ACSS/TW), Aluminum Conductor Aluminum Alloy Reinforced (ACAR) and Aluminum Conductor Composite Core (ACCC).

Connectors play a critical role in the efficiency and reliability of power transmission systems. Cables used for overhead transmission lines require connectors for splices and dead end assemblies. Commonly assigned U.S. Pat. No. 7,874,881 discloses a full tension fitting for all-aluminum cables. While this fitting could be used with reinforced cables having a load-carrying core surrounded by conductor strands, the resulting connection would not withstand the same high tensile load that the cable itself is designed to withstand. Connectors for reinforced cables typically comprise a two-part assembly with a connector body and an insert or core grip. The insert is first fastened to the cable core and then the connector body is fastened to the insert and to the cable conductors. For swaged connectors, this requires two different sized dies.

SUMMARY OF INVENTION

The present invention provides an improved cable connector with an insert having an axial bore dimensioned to receive the core of the cable. A connector body has a substantially cylindrical outer surface and a substantially cylindrical cavity. A distal portion of the cavity having a first substantially cylindrical inner surface is dimensioned to receive the connector insert. A second portion of the cavity proximally displaced from the distal portion has a substantially cylindrical second inner surface dimensioned to receive the conductor strands of the cable. The connector body may be configured with one or more additional portions of the cavity having substantially cylindrical inner surfaces with progressively increasing diameters, the number of such portions depending on the size of the cable. Alternatively, the inner surface of the cavity may have a slight taper. Using a single die, the connector body is compressed with a swaging tool at several axially spaced-apart locations to grip the conductor strands and also to compress the connector insert, thereby gripping the core of the cable. Alternatively, using two different dies, the connector core may be compressed after the core of the cable is inserted, but before the connector core is inserted into the connector body.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

The invention is described with reference to an ACSR cable; however, the invention is also applicable to ACSS, ACSS/AW, ACSS/TW, ACAR, ACCC and other reinforced cables having a load-carrying core surrounded by conductor strands. The core may comprise steel, high-strength aluminum alloys or composite materials, whereas the conductor strands may comprise aluminum, copper or alloys thereof.

Figure 1:
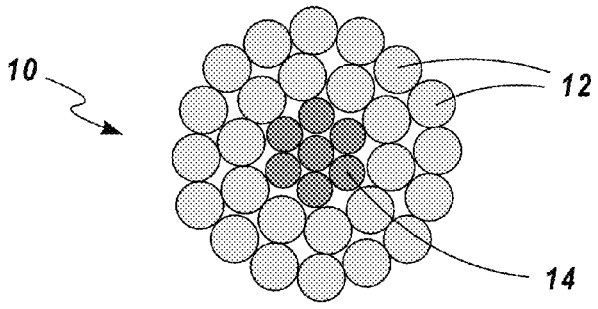
Fig. 1 (prior art)
FIG. 1 is a cross-sectional view of an ACSR cable.

A common type of ACSR cable 10 is illustrated in FIG. 1. This particular type of cable, having an industry designation 26/7, has twenty-six outer strands of aluminum conductor 12 surrounding a core 14 comprising seven strands of steel. As explained above, the steel core is a primary contributor to the tensile strength of cable 10.

Figure 2:
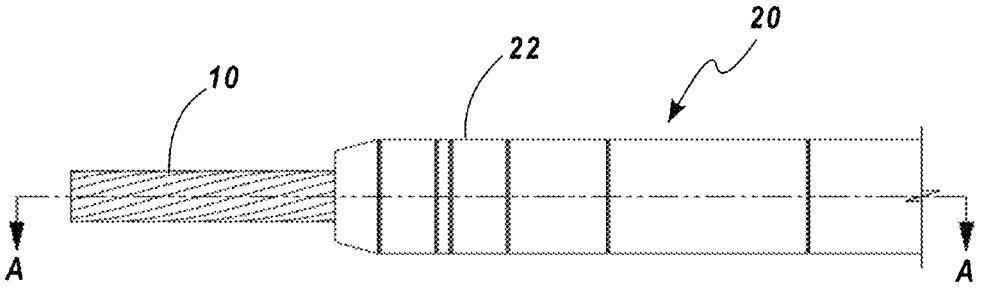
FIG. 2 is a side elevation view of a connector in accordance with an embodiment of the present invention installed on a cable.
Figure 3:
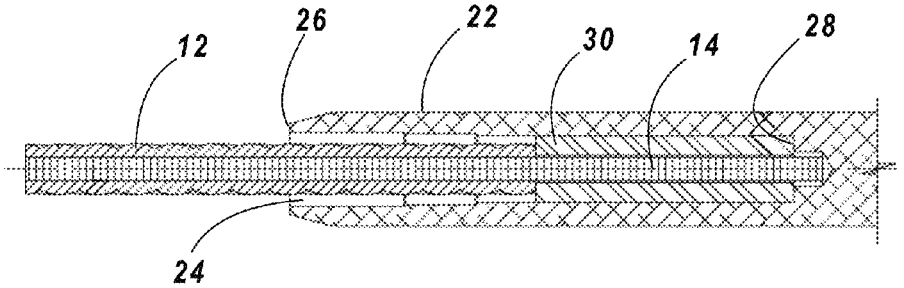
FIG. 3 is a cross-sectional view through line A-A of the connector and cable shown in FIG. 2.

A connector 20 in accordance with one embodiment of the present invention is shown in FIGS. 2 and 3. The connector body 22 has a substantially cylindrical outer surface and has a bored-out central cavity 24 extending from the proximal end 26 to an annular seating surface 28. A connector insert 30 is inserted into cavity 24 and rests against seating surface 28. The aluminum strands at the end of cable 10 are removed for a distance approximately equal to the length of the connector insert. The end of cable 10 is inserted into cavity 24 with the steel core 14 fitting into a central axial bore in the connector insert 30 and the cut-back ends of the aluminum strands enclosed within the proximal portion of cavity 24. Once assembled in this fashion, the connector 20 is secured to the end of cable 10 with multiple swages as described below.

Connector 20 may be configured either as a splice connector with a tubular body receiving a cable at each end or as a full tension dead end having a suitable structural coupling, such as an eye or clevis, at the distal end of the body. Alternatively, a dead end structural coupling may be incorporated in the connector insert. Connector body 22 may be fabricated with a suitable aluminum alloy, such as 3003-H18.

Figure 4:
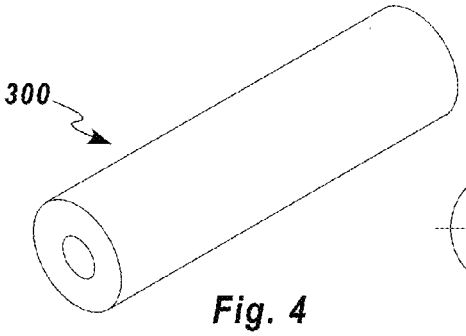
FIG. 4 is a perspective view of a first type of connector insert.
Figure 5:
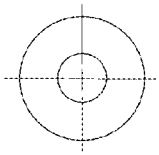
FIG. 5 is an end view of the connector insert shown in FIG. 4.
Figure 6:
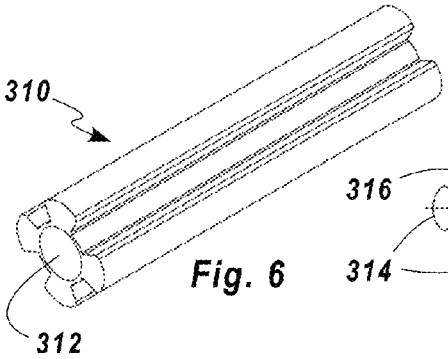
FIG. 6 is a perspective view of a second type of connector insert.
Figure 7:
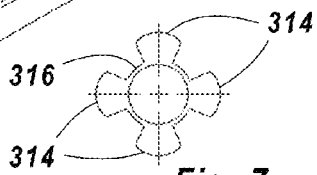
FIG. 7 is an end view of the connector insert shown in FIG. 6.
Figure 8:
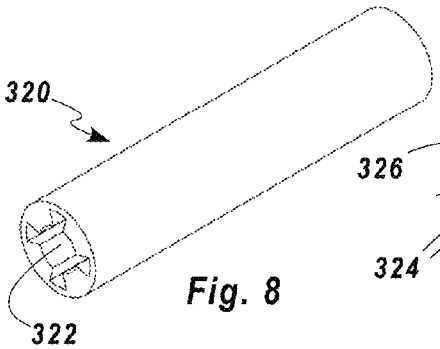
FIG. 8 is a perspective view of a third type of connector insert.
Figure 9:
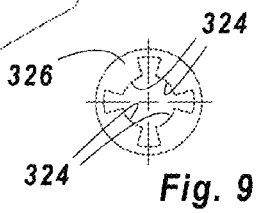
FIG. 9 is an end view of the connector insert shown in FIG. 8.
Figure 10:
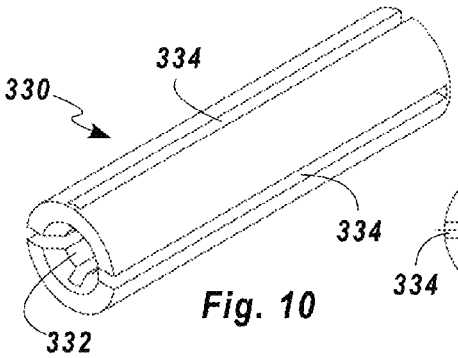
FIG. 10 is a perspective view of a fourth type of connector insert.
Figure 11:
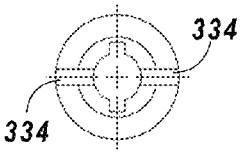
FIG. 11 is an end view of the connector insert shown in FIG. 10.

Connector insert 30 may be configured as a simple tubular body 300 as illustrated in FIGS. 4 and 5 or may be configured in accordance with one of several other designs. One such design is illustrated in FIGS. 6 and 7. Connector insert 310 is configured as a tube with a central axial bore 312 and, in cross-section, spokes 314 radiating outwardly from an annular region 316 surrounding the central bore. Another connector insert design is illustrated in FIGS. 8 and 9. Connector insert 320 is configured as a tube with a central axial bore 322 and, in cross-section, spokes 324 radiating inwardly from circular outer portion 326. Yet another connector insert design is illustrated in FIGS. 10 and 11. Connector insert 330 is generally tubular in configuration with a central axial bore 332 and a plurality of axially extending slots 334 similar to a collet chuck. The scope of the invention is not limited to these particular configurations. Other configurations of connector inserts may be employed to serve the purpose of gripping the core of the cable when the connector body is swaged around the connector insert. The connector insert may have aluminum oxide or other suitable grit bonded onto the inner surface of the axial bore to increase the mechanical grip on the core of the cable. Alternatively, the inner surface of the axial bore may be machined with female threads, circumferential teeth or other surface finishes to enhance the connector insert's grip on the core of the cable. Furthermore, the connector insert, rather than the connector body, may incorporate the structural coupling of a dead end connector, such as an eye or clevis. The connector insert may be fabricated with suitable aluminum or steel alloys, such as 6061-T6 aluminum or tool steel.

Figure 12:
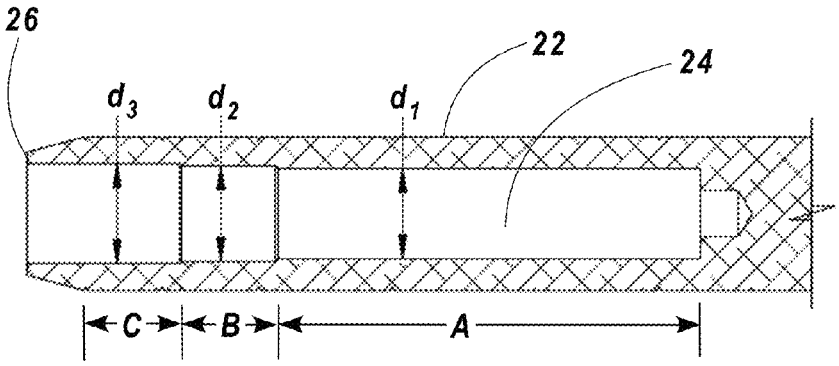
FIG. 12 is a cross-sectional view of the connector body shown in FIG. 2.

FIG. 12 is a cross-sectional view of connector body 22 illustrating its internal structure. In portion A of the connector body, where the connector insert is inserted, cavity 24 has a diameter $d_1$, which is only slightly larger than the outer diameter of the connector insert. Moving from portion A towards the proximal end 26 of the connector body, the diameter of the cavity is increased in steps. Each such step transfers a different compression force to the cable and serves to distribute the swaging load to all of the aluminum strand layers in the ACSR cable. Portion B of cavity 24, which is proximally adjacent to portion A, has a diameter $d_2$. As illustrated here, $d_2$ is larger than $d_1$. However, portion B may have the same diameter as portion A. Portion C of cavity 24, which is proximally adjacent to portion B has a diameter $d_3$, which is larger than $d_2$. Additional proximally displaced portions of cavity 24 may have further stepped-up diameters. The number of steps may be fewer or greater than illustrated in the figures and will generally be determined by the size of the cable.

Figure 13:
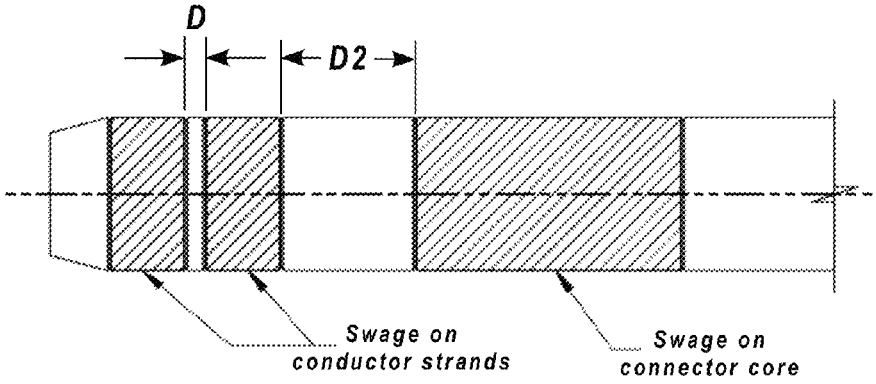
FIG. 13 illustrates the swaging regions on the connector body.

Referring now to FIG. 13, after the cable and connector insert have been inserted into cavity 24, the outer connector body is swaged at several locations to secure it uniformly around the aluminum strands of the cable and around the connector insert that grips the steel strands of the cable. The swaging operation is preferably performed using the 360° Radial Swage Tool manufactured by DMC Power, Inc. of Gardena, Calif. The connector body is swaged within portion A to secure the connector insert and the steel core of the cable. Multiple overlapped swages may be needed to fully secure the cable insert. The connector body is also swaged within portions B and C to secure the aluminum conductor strands. The compression ratio and the compression stress are increased approximately 3% to 20% at each portion as the internal diameter of the connector body decreases. There is a space or gap, denoted as D, between any consecutive swages on the aluminum strands. This space, in the range of about 0.1" to 0.5", allows the aluminum strands to flare out behind each swage and lock the cable behind the swage when it is subjected to tensile force. Additionally, there is a gap D2 between the swages in portions A and B, which also allows the conductor strands to flare out. The swage in portion A securing the connector insert and the steel core of the cable disposed therein has the primary function of transmitting the tensile load of the cable through the connector, whereas the swages in portions B and C (and any additional portions with further stepped up internal diameters) add to the tensile strength, but also serve the function of establishing electrical conductivity between the cable and the connector. Since the outer connector body has a uniform diameter, only a single die is required to swage the connector body in each of portions A, B and C.

As with prior art connectors for reinforced cables, connector 20 may also be attached to the cable using two dies with a somewhat different sequence of steps. The connector insert, which in this case may be a simple tube as shown in FIGS. 4 and 5, may first be swaged onto the cable core with a smaller die sized to the outer diameter of the insert. Then, the connector body may be swaged onto the connector insert and cable conductors with a larger die sized to the outer diameter of the connector body. In this case, the conductor strands at the end of cable 10 are first removed for a distance approximately equal to the length of the connector insert as described above. The exposed core at the end of cable 10 is inserted into the central axial bore in the connector insert 30 and a suitably sized die is used to swage the connector insert onto the cable core. The connector insert is then inserted into cavity 24 of connector body 22 until it abuts seating surface 28. The connector body is then swaged onto the connector insert and the conductor strands of the cable as previously described.

Figure 14:
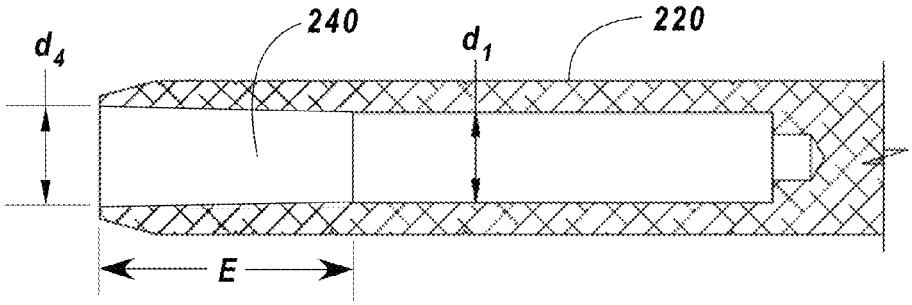
FIG. 14 is a cross sectional view of a connector body in accordance with another embodiment of the invention.

FIG. 14 is a cross-sectional view of a connector body 220 in accordance with another embodiment of the invention. Whereas the internal cavity 24 of connector body 22 is stepped, cavity 240 of connector body 220 is tapered from $d_1$ to $d_4$ in portion E. This configuration also results in each swage applied to the connector body within portion E transferring a different compression ratio and compression stress to the cable as a function of the internal diameter at each swage location so as to distribute the swaging load to all of the conductor strand layers in the cable.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A connector for an electrical cable having a core surrounded by a single layer of conductor strands comprising:

a connector insert having an axial bore dimensioned to receive the core of the cable;

a connector body having an opening at a proximal end thereof and a substantially cylindrical outer surface, the opening communicating with a cavity having a distal portion dimensioned to receive the connector insert, said distal portion having a first inner surface with a first inside diameter, said cavity further having a second portion proximally displaced from the distal portion having a second inner surface with a second inside diameter dimensioned to receive all strands of said single layer of conductor strands, wherein the second inside diameter is greater than the first inside diameter, said cavity further having a third portion proximally adjacent to the second portion, said third portion having a third inner surface with a third inside diameter dimensioned to receive all strands of said single layer of conductor strands, wherein the third inside diameter is greater than the second inside diameter;

wherein the ratio of the third inside diameter to the second inside diameter is such that, with all of the conductor strands disposed within the second portion of the conductor body and with all of the conductor strands also disposed within the third portion of the connector body, swaging compression applied to the cylindrical outer surface of the connector body secures the connector body to the conductor strands in both the second and third portions.

2. The connector of claim 1 wherein the cavity is stepped between the second and third inner surfaces.

3. The connector of claim 1 wherein the cavity is tapered between the second and third inner surfaces.

4. The connector of claim 1 wherein the connector body is configured as a splice.

5. The connector of claim 1 wherein the connector body is configured as a dead end.

6. The connector of claim 1 wherein an axial cross-section of the connector insert has a plurality of spokes radiating outwardly from an annular region surrounding the bore.

7. The connector of claim 1 wherein an axial cross-section of the connector insert has a plurality of spokes radiating inwardly from a circular outer perimeter.

8. The connector of claim 1 wherein the connector insert is generally tubular with a plurality of axially extending slots.

* * * * *